United States Patent [19]

Whiteman et al.

[11] 4,373,731

[45] Feb. 15, 1983

[54] BOARD GAME

[76] Inventors: Dennis J. C. Whiteman, 122 Maude St., Geelong, Victoria; Gary R. C. Whiteman, 122 Maude St., Gellong, Victoria, both of Australia

[21] Appl. No.: 140,389

[22] Filed: Apr. 14, 1980

[51] Int. Cl.[3] ..... A63F 3/00

[52] U.S. Cl. ..... 273/262

[58] Field of Search ..... 273/253, 255, 236, 260, 273/261, 262, 282, 287

[56] References Cited

U.S. PATENT DOCUMENTS

| | | | |
|---|---|---|---|
| 628,773 | 7/1899 | Davis | 273/262 |
| 838,461 | 12/1906 | Salvador | 273/263 |
| 972,382 | 10/1910 | Johnson-Jervis | 273/255 |
| 1,025,940 | 5/1912 | Archer | 273/263 |
| 1,149,918 | 8/1915 | Johnson, Jr. | 273/262 |
| 1,245,096 | 10/1917 | Foster | 273/255 |
| 1,367,261 | 2/1921 | Hudon | 273/255 |
| 1,666,953 | 4/1928 | Tuttle | 273/262 |
| 3,610,626 | 10/1971 | Nolte | 273/261 |
| 3,831,944 | 8/1974 | Upton | 273/262 |
| 4,123,062 | 10/1978 | Wexler | 273/248 |
| 4,171,814 | 10/1979 | Tamano | 273/248 |

FOREIGN PATENT DOCUMENTS

| | | | |
|---|---|---|---|
| 950346 | 9/1949 | France | 273/262 |
| 2371945 | 7/1978 | France | 273/262 |
| 2376673 | 9/1978 | France | 273/262 |
| 13190 | of 1915 | United Kingdom | 273/262 |
| 979214 | 1/1965 | United Kingdom | 273/255 |
| 1501299 | 2/1978 | United Kingdom | 273/249 |

*Primary Examiner*—Richard J. Apley
*Assistant Examiner*—Carl Moy
*Attorney, Agent, or Firm*—Leitner, Palan, Martin & Bernstein

[57] ABSTRACT

A board game for simulating a war including a playing board divided into a plurality of segments. The segments may also be divided into a plurality of discrete areas of different representations, for example, land and sea. The players are provided with a plurality of sets of playing pieces adapted for movement along the playing areas formed by the segments. Each set of playing pieces includes at least two different types of pieces having predetermined movements and capable of removing an opponent's pieces, in accordance with the result of a random number generator, for example dice.

10 Claims, 9 Drawing Figures

BOARD GAME

The present invention relates to a board game and refers particularly, but not exclusively, to a board game for simulating a war.

In this specification "board game" includes a simulation of the game using any visual media e.g. a computer simulation of the game on a video screen, together with such ancillary electronic circuitry and other apparatus as is necessary or incidental to such simulation.

In accordance with one aspect of the present invention there is provided a board game including, a playing board divided e.g. gridwise into a plurality of segments, a plurality of sets of playing pieces adapted for movement along playing areas formed by said segments; each set of playing pieces including at least two different types of pieces having predetermined movements and capable of removing opponent's pieces, after said predetermined movements, in accordance with the result of a number produced by a random number generator such as a die or dice.

In accordance with another aspect of the invention, a board may be divided, by a square, rectangular or other grid, into a plurality of segments, and further divided into two or more discrete areas of different kinds. For example, a first kind of area may represent "land", and a second kind, "sea". Each of two or more players may be provided with pieces of two or more types, such as "cannon" and "ships" and the rules may provide that only pieces of one type e.g. "cannon", can venture into one kind of area e.g. "land", although a player may be permitted to "transport", over an area, a piece that is not permitted to venture thereon. This transportation may be effected by associating the piece with another of the player's pieces of an appropriate type. Thus e.g. a "ship" may transport a "cannon" over a "sea" area. Subject thereto, and any other special rules, the pieces move in their respective areas according to predetermined movements.

A preferred embodiment of the board game of the present invention is described below with reference to the accompanying drawings wherein like numerals denote like members and wherein.

Figure 1:
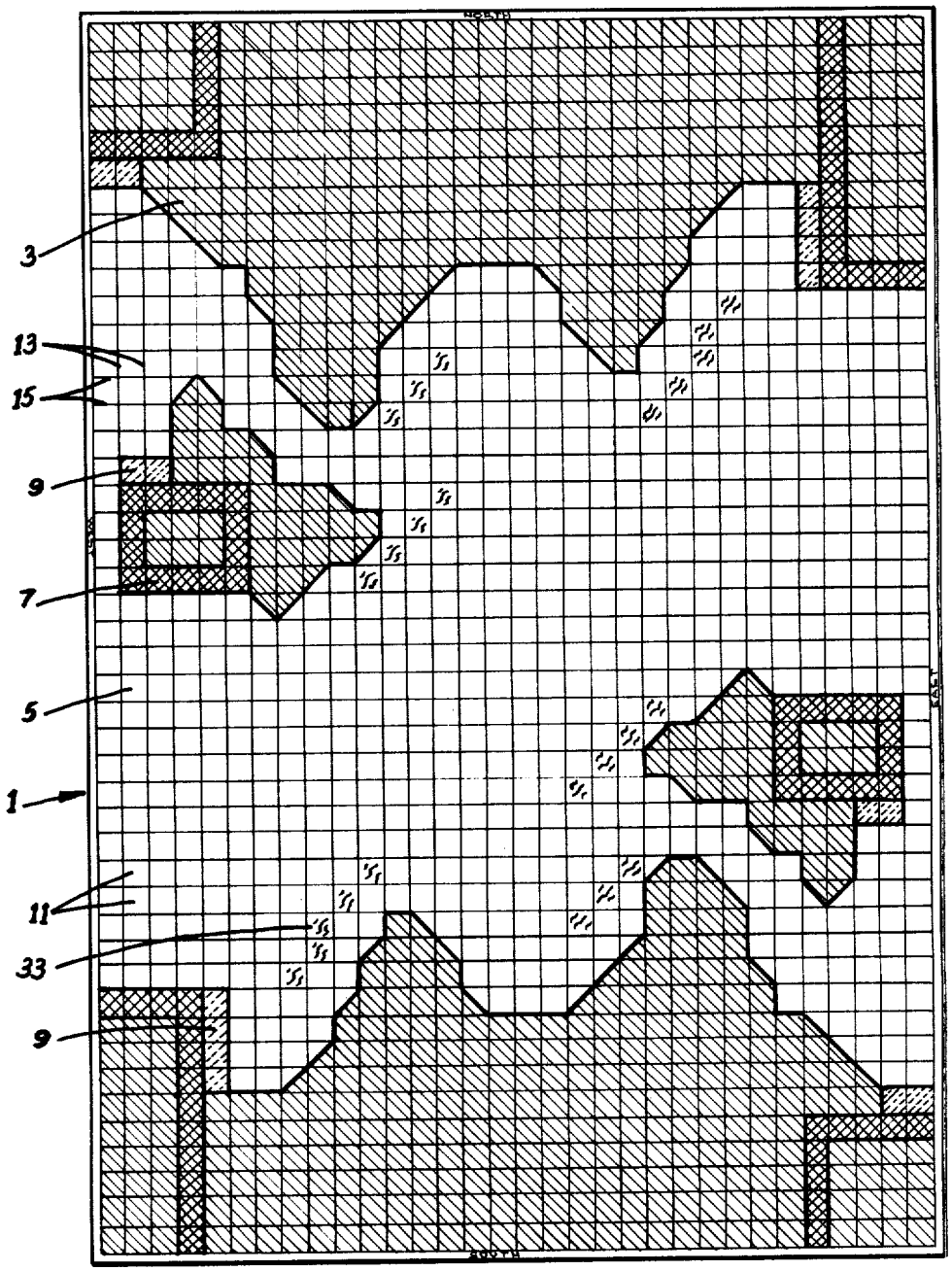
FIG. 1 is a schematic illustration of a segmented map such as may be used as a board in playing a game of the present invention.
Figure 2:
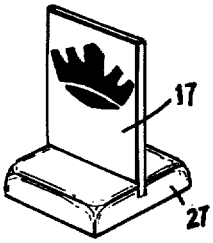
FIG. 2 illustrates a "king" playing piece located within a holder.
Figure 3:
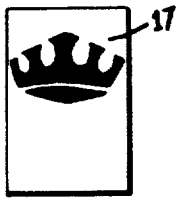
FIG. 3 shows the king playing piece without its holder.
Figure 4:
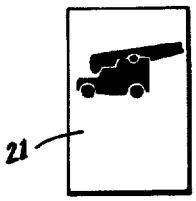
FIG. 4 shows a cannon playing piece.
Figure 5:
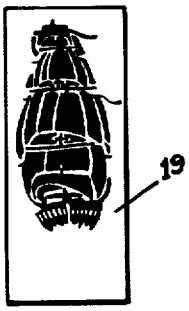
FIG. 5 shows a ship playing piece.
Figure 6:
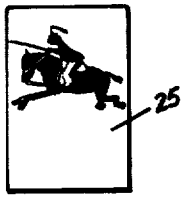
FIG. 6 shows a cavalry playing piece.
Figure 7:
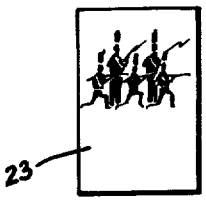
FIG. 7 shows a soldier playing piece.
Figure 8:
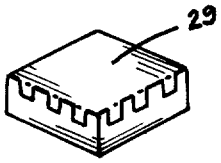
FIG. 8 shows a fort block.
Figure 9:
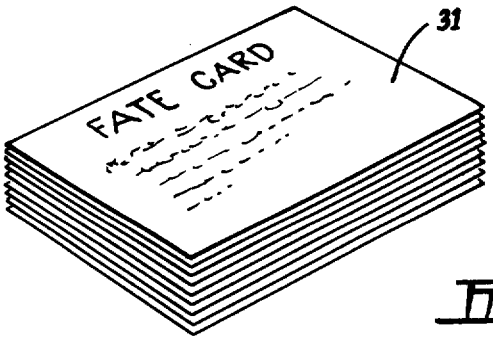
FIG. 9 shows instruction cards.

Following, in outline form, are representative general instructions, idea of the game, playing components and rules of a preferred embodiment of the board game for simulating battle situations of the Napoleonic Wars.

A BRIEF IDEA OF THE GAME

At the start of the game, each player controls an army, ships and fort(s) and has his own memory. In each turn a player has four sets of moves—his first with his ships, his second with his cannon, his third with his soldiers and cavalry and his fourth with his king. After moving his ships, he may shoot with them (the same applying for his cannons and then for his soldiers and cavalry). To shoot with pieces, the player rolls the die and then removes enemy pieces that have been "hit". A "hit" is recorded when an enemy piece is the exact number of spaces away as shown on the die. A player may buy new pieces from the Bank and pay to rebuild smashed forts whenever he rolls a six. When he rolls a six, he also takes a Fate Card from the top of the card pack and carries out the instructions. As in life, where the player experiences unexpected fluctuations of fortune, the Fate Cards can cause a variety of interesting things to happen—all true to the functioning of the period. The object of the game is to emerge as the conqueror by wiping the enemy from the board or by eliminating the enemy king(s).

PARTS USED IN THE GAME

The board has different coloured squares for land, sea, fort walls and ports over which the players move their pieces. There are different coloured pieces for each of the four opposing forces. Each of the four sides can have on the board a total of 10 ships, 12 soldiers, 10 cannons, eight cavalry pieces and a king. There are also 72 fort wall blocks, 40 Fate Cards, one die, money and transport tokens.

SETTING UP THE BOARD

The board is placed on a table, putting the pieces nearby. The Fate Cards are shuffled and placed face down. The fort wall blocks are placed on the fort squares with the wall fronts facing outwards. The die is rolled and the player with the highest number gets first choice of forts, colour of pieces and takes first turn in the game. The next player to his left becomes Banker for the game and has second turn and so on.

After the forts are chosen, each player takes four ships of his colour and places them on the four port squares associated with his fort(s). Next, each player places eight soldiers and eight cannons and the king of his colour anywhere inside his fort(s) as well as on the walls, if he so desires. Next, four cavalry units are placed either on squares inside his fort(s) or within six squares of his own fort(s) walls. (Cavalry units are never, at any time, placed on wall blocks). The Banker now gives each player a total of 1500 guineas as follows: two 500 guinea notes and five 100 guinea notes.

MOVING PIECES

Each player's turn is divided into four parts which give him the chance of moving up to four of each kind of his pieces in any one turn. The order of play and the number of squares pieces can be moved are as follows:

1. Four ships up to six squares each.
2. Four cannons up to two squares each.
3. Four soldiers up to four squares each plus four cavalry units up to six squares each.
4. The king up to six squares.

When moving, a player takes the piece he wants to move and moves it in any direction, or combination of directions, but, once he has taken his hand off it, that piece must stay where he has left it for that turn.

No two movable land pieces may share the same square and no two ships may share the same square.

For the purpose of battlefronts forming when armies meet, all kings, cannons, soldiers and cavalry units control all eight squares that touch the square they are on, and no enemy land pieces may move onto or through those squares.

No piece can be jumped or counted over another movable piece, and no piece can be moved through, or placed in, a square which contain half sea and land.

All land pieces can move freely over their own fort walls, but never enemy fort walls. Kings, cannons and soldiers may be moved onto their own fort walls, but never enemy walls. Cavalry units can never be placed on fort walls, but can be counted over them.

Ships cannot be moved through reefs.

SHOOTING WITH PIECES

In a full turn, a player gets to shoot at his enemy three times. The three assaults are with:

1. Ships (after he has finished his move with them).
2. Cannons (after he has finished his move with them).
3. Soldiers and cavalry simultaneously (after he has finished his move with them).

The king never shoots.

To shoot with a piece, or pieces of the same kind, the player rolls the die once. The one roll fires for all his ships on the board, or all of his cannons, or simultaneously for all of his soldiers and cavalry units.

When pieces shoot, they fire in eight straight directions at once. If, for example, a two is rolled, the player's shots are counted out for two squares from each piece in all eight straight directions; if a three, for three squares in all eight straight directions and so on.

When counting out shots from a piece, the square the piece is on is not counted. All enemy pieces on squares where the shots land are "hit" and removed from the board. Enemy pieces that shots are counted over are not "hit" and remain on the board. A player's own pieces are not removed from the board if hit by his own fire power.

Pieces never move during shooting: They remain where located and shots are counted out from them in all eight straight directions.

All pieces are capable of shooting over all types of pieces, apart from enemy fort wall blocks. Also, a player can shoot over his own fort wall blocks only when he is shooting from behind the wall.

The different kinds of pieces on the board have different striking powers which are:

Ships and cannons can destroy all types of pieces on the board.

Soldiers and cavalry units can both destroy cannons, soldiers and cavalry units, but cannot destroy fort wall blocks or sink ships. With a single "hit" on a ship, they can destroy all pieces on board that ship.

The king does not shoot.

THE ORDER OF PLAY

In each turn a player works through the following seven steps as explained in simple terms below:

STEP 1—Move your ships: A player may move any 1, 2, 3 or 4 of his ships up to six squares each. Ships can be moved only on sea squares and cannot be placed in enemy port squares.

STEP 2—Fire with ships: The player rolls the die once to shoot with all his ships on the board. The number on the die is the number of squares all of his ships shoot in all eight straight directions. He can shoot with his ships only if there is an enemy piece he may possibly hit, otherwise he moves into Step 3. After rolling the die, all enemy pieces (including fort wall blocks) that are "hit" are removed from the board. Ships can shoot up to a distance of six squares each.

STEP 3—Move your cannons: Any 1, 2, 3 or 4 of a player's cannons can be moved 1 or 2 squares each. Cannons may move on any land squares and may also be moved onto, over or along their own fort walls. They may not be moved onto or over enemy walls.

STEP 4—Fire with your cannons: Firing is the same for cannons as it is for ships. Cannons can also shoot up to a distance of six squares each.

STEP 5—Move with your soldiers and then move with your cavalry: First move any 1, 2, 3 or 4 soldiers up to 4 squares each and then move any 1, 2, 3 or 4 cavalry units up to six squares each. Other rules are the same as for moving cannons, except that cavalry units cannot be stationed on fort walls.

STEP 6—Fire with your soldiers and cavalry together: The player rolls the die once to shoot simultaneously with all of his soldiers and cavalry units on the board. Soldiers and cavalry units can destroy enemy pieces only when a 2, 3 or 4 is rolled—the numbers 1, 5 and 6 being ineffective firing ranges. As with ships and cannons, firing does not take place if there are no enemy pieces that can possibly be hit.

STEP 7—Move the king: Rules for moving the king are the same as for moving cannons and soldiers, except that the king can be moved up to six squares in each move.

WHEN A "SIX" IS THROWN

Each time a player rolls a "six", he shoots in the usual way then takes a Fate Card from the top of the pack and reads it aloud for all to hear. He does exactly what the card says, then places it at the bottom of the pack. After this, he may buy new pieces from the Bank.

HOW TO BUY NEW PIECES

A player can buy new pieces from the Bank only after he has rolled a "six" and carried out the instructions on the Fate Card. IF he does not buy before the next step in the game starts, he may not buy until he throws another "six".

Before a player can buy new military pieces, he must have a fully built fort(s) in which to place them. All newly purchased pieces must be placed inside the walls of fully built fort(s) and new ships in the dark blue port squares of his fully built fort(s).

PURCHASE PRICES OF NEW PIECES

Prices of pieces bought from the Bank are as follows:

Fort wall blocks: 100 guineas for two. If only one is required, the cost is still 100 guineas.

Ships: 500 guineas each.

Cannons: 400 guineas each.

Cavalry: 300 guineas each.

Soldiers: 200 guineas each.

All pieces paid for must be placed on the board immediately. They cannot be stored off the board for replacement at a later date.

WHEN A KING IS "HIT"

When you score a "hit" on an enemy king, the owner of the king must surrender at once. All of his pieces, apart from fort wall blocks, are removed from the board and you receive 2,000 guineas from the Bank, plus any money that the surrendering player may have.

THE ADVANTAGES OF FORTS

As in real life, fort walls offer protection and give cannons and soldiers on them a fire-power advantage.

Firing pieces from walls: Only cannons and soldiers can shoot from fort walls. When they shoot "a three is added" to the number shown on the die. This means that if a one is rolled the piece(s) hits four squares away; if a two, five squares away and so on. "No piece" can fire along fort wall blocks, no matter whether they are on the wall or off it.

Firing with pieces over fort walls: All of a player's pieces can fire over his own fort walls, but only from behind the wall. No piece can shoot over an enemy wall at any time.

Destroying pieces on walls: When fire power from a ship or cannon "hits" an enemy wall block, the block is removed as well as any piece that may be on it. When a soldier or cavalry unit "hits" an enemy piece on a fort wall, the block stays put but the piece is removed.

Taking enemy forts: Enemy forts can be entered through gaps that have been blown in the walls. The rule on the one-square distance which must be kept between opposing army pieces is still observed inside forts. A fort entered during a siege still remains the property of the defender until he has no pieces left in it. It becomes the attacker's fort when only his pieces are in it.

Owning forts: A player owns a fort while he has at least one of his pieces in it or a ship in the port. If he moves all of his pieces out, it is no longer his fort. It becomes the property of the first player who moves a piece into it, whether it be a land or ship piece.

Ships and fort wall blocks: The one-square distance rule does not apply to: (i) ships and fort wall blocks, (ii) ships and movable land pieces, (iii) ships with other ships.

TRANSPORTING PIECES WITH SHIPS

Transport tokens, used with transporting military pieces aboard ships, are provided marked for kings, cannons, soldiers and cavalry units. When a piece is loaded onto a ship, it is removed from the board and a transport token is placed alongside the ship, the arrow on the square pointing to the ship. If more than one piece is aboard a ship, the tokens are placed on top of each other.

A player can transport pieces only if the appropriate tokens are available. The tokens are removed from the board as the pieces are put ashore or the ship sunk. A token represents one of its kind.

Loading and unloading from home ports: A ship in a home port can load and unload pieces directly from anywhere in that port or from anywhere on its fort walls. In one turn, a player can move a ship into a port square, pause to load or unload (or both) and then complete his move with that ship.

Loading or unloading ships outside ports: For this to occur, a ship must not be in a square where only one corner touches the land—at least one full side of a square must border the land. When pieces are being loaded or unloaded from ships not in ports, they each get a free normal turn, either onto the ship or off it. In one turn a player can move a ship into the shore, pause to load or unload (or both) and then complete his move with that ship. The ship's complete move must be carried out before the next ship is moved in the turn. Ships cannot be loaded or unloaded from fort walls, but can load or unload from gaps in the walls in the same way as for loading and unloading outside of ports.

CAPTURING SHIPS

When firing with ships and a "one" is rolled and an enemy ship is "hit" it is not sunk—it has been boarded and captured and is replaced by a ship of the colour of the captor's pieces. Any pieces being carried by the captured ship also becomes the property of the captor. If the captor has his full quota of any kind of piece on the board he collects the purchase value of the piece in money from the Bank. There is no limit to the number of ships a single ship can capture in a single turn.

MISCELLANEOUS

When a piece can be sold: Pieces can be sold to the Bank only when an immediate debt is owed and the player does not have the cash to pay. Wall blocks can never be sold, but a player can sell his fort to another player for a negotiated price. If a player has money on hand when a debt is owed, he must pay with the money and not trade pieces to the Bank.

Once a wall block is placed on the board, it cannot be moved to any other square.

When a player has his full quota of a certain kind of piece on the board and is awarded more of that piece—by capturing a ship or from the Fate Cards—he collects their purchase value from the Bank.

When firing with a "line-up" of cannons or ships, it is permitted to destroy a fort wall block and then pieces behind that wall block in the one firing.

A fort cannot be repaired when enemy pieces are within the walls or located on any of the fort squares belonging to that fort.

A wall block cannot be placed on a square already occupied.

Gifts and loans of money and pieces are not permitted.

A limited game can be played to a pre-arranged time. When this is decided on, the value of all pieces (including wall blocks) owned by the players are totalled. The player with the greatest worth is declared an "advantage winner". An "outright win" is achieved only when a player emerges total victor, having wiped the board of all enemy pieces.

In order that the invention may be more clearly understood there shall now be described a practical embodiment of a board game with reference to the accompanying drawings. The description is given by way of non-limitative example only.

The game will be described with reference to a war game wherein the object of the game is to remove the opponent's pieces from the board.

The board 1 may be formed from plastics, cardboard or any other suitable material. The board represents a map showing land masses 3 and water 5. A plurality of forts 7 (third kind of "area") each having an associated port 9 (a fourth kind of "area") are marked on the map, establishing each opponent's home base. The map is divided into segments 11 by a grid representing meridians of longitude 13 and parallels of latitude 15.

Each player has a set of pieces of different types. In this embodiment each player has a king piece 17 and a plurality of ship 19, cannon 21, soldier 23 and cavalry 25 pieces. These pieces may be inserted into a holder 27 or may, if desired, be moulded into a shape representative of the function of the piece similar to chessmen. All of these pieces are, subject to particular conditions as shall appear hereinafter, capable of removing opponent's pieces from the board except for the king 17. The king 17 has a similar stature to the king in chess, whereby a player retires from the game if his king is "captured" (compared with "checkmate") no matter how many other pieces he may have on the board.

On setting up the board 1, each player places his ships 19 in a respective port 9 and builds his fort with appropriate blocks 29 on a respective fort area 7. The remaining playing pieces are located within, on or around the fort walls 29. On a respective player's turn he may move his pieces to attempt to invade or destroy an opponent's fort and remove the opponent's pieces from the board.

In one form of the game each player has, in addition to his fort blocks 29, one king 17, six ships 19, twelve soldiers 23, ten cannons 21 and eight cavalry pieces 25. On his turn a player may move four of his ships 19 up to six segments each, four cannons 21 up to two segments each, four soldiers 23 up to four squares each, four cavalry 25 up to six segments each and his king 17 up to six segments. After movement of a respective type of piece (except for the king) the player may attack his opponent's pieces by rolling a die to determine the firing range or strike power of that particular type of playing piece. The range of firing may be directly determined by the roll of the die with or without additional conditions or constraints. The attack on an opponent's piece may be in any direction from the player's piece being fired, or a direction or directions determined by a die roll.

In moving pieces during a turn it must be kept in mind that each type of piece has limitations. These limitations arise due to the restricted movements and firing power of each piece. A ship 19 cannot move across land 3 or through reefs 33, and the land pieces cannot move across water 5. To enable a player to invade his opponent's fort(s) his land pieces may be transported across the water on a ship. As a player may be invaded by land he may also have his ships captured by the enemy who will also take any land pieces being transported.

A player whose fort 7 is under attack may protect himself by firing on his attackers from the fort walls 29 or over his fort walls. The fort 7 and its occupants are safe from invasion for as long as the fort wall remains intact. If a ship 19 or cannon 21 has a direct hit on a segment of the fort wall 7 that fort block 29 is removed and the enemy may enter through the breach.

It will be seen that the fort blocks 29 partake of the nature of land "areas" to the extent that they limit movement of pieces, and they also resemble pieces insofar as they can be removed from (although not moved over) the board, and can be bought and sold. Considered as a "third kind of area" it will be apparent that the segment covered by a block 29 will normally become a "first kind of area" i.e. land, if and when the block is removed.

To add further excitement to the game, a set of instruction cards 31 similar to "Chance" cards in "Monopoly" (Registered Trade Mark) may be included to be acted upon on a predetermined die roll e.g. a "six". These cards may enhance or detract from the player's position or situation in the game. Representative cards which may be used include "Your king weds a foreign princess. You receive a dowry of 400 guineas from the Bank" or "Your fort's north wall is blown up in a gunpowder explosion. Remove the five wall blocks, and any pieces on them from the board".

Each player may be issued with "money" which may enable him to replace his attacked playing markers or fort walls, or increase the strength of his forces.

Although the invention has been described with reference to a war board game it is obvious that the game could be adapted to any other type of board game. It is equally obvious that the types of playing markers, numbers thereof, movements thereof and rules controlling the game may be amended to add or remove additional features to the game.

It is to be understood that the game may be made modified in details of construction and design without departing from the ambit of the invention, the nature of which may be ascertained from the appended claims.

We claim:

1. A war game combining elements of skill and chance including:

a playing board having a grid pattern thereon made of contiguous segments, said playing board being divided into land areas having land indicia thereon comprising at least one grid segment called a land segment, and sea areas having sea indicia thereon comprising at least one grid segment called a sea segment;

a plurality of sets of playing pieces adapted for movement within prescribed areas;

a random number generator;

at least one fort area on said playing board comprised of a plurality of contiguous segments surrounded by either contiguous fort perimeter segments having fort perimeter indicia thereon or surrounded by a combination of contiguous fort perimeter segments and the border of said board; and a plurality of removable fort block means, one fort block means placed on each said fort perimeter segment, capable of being removed therefrom, for allowing entry into said fort areas by at least one type of playing piece when at least one fort block means is removed.

2. A war game as claimed in claim 1, wherein said plurality of removable fort block means each have a cross-sectional area substantially equal to the cross-sectional area of said fort perimeter segments.

3. A war game as claimed in claim 1 wherein said playing board includes at least one port area having port defining indicia thereon, said port area is located on segments contiguous to at least one fort perimeter segment and one of said sea segments.

4. A war game combining elements of skill and chance including:

a playing board having a grid pattern thereon, made of contiguous segments, said playing board being divided into land areas having land indicia thereon comprising at least one grid segment called a land segment and sea areas having sea indicia thereon comprising at least one grid segment called a sea segment;

a plurality of sets of playing pieces adapted for movement within prescribed playing areas;

each piece of a particular set of playing pieces having first indicia thereon common to all members of that particular set to identify the piece as belonging to a particular player, each set of pieces comprising a plurality of types of individual pieces, each piece of a particular set of playing pieces having second indicia thereon common to all members of that particular type to identify the piece as a particular type of piece, the particular types being:

land pieces adapted to be moved over the land segments, sea pieces adapted to be moved over the sea segments, transport tokens representing different land pieces while being transported by sea pieces, each transport token having thereon third indicia corresponding to the second indicia of the land piece represented, and additionally having thereon pointing indicia whereby a said transport token may be placed adjacent to a sea piece with the pointing indicia directed thereat to indicate that the sea piece is transporting the indicated land piece.

5. A war game as claimed in claim 4 wherein said playing board includes at least one fort area located on said land segment having fort indicia thereon, and at least one port area having port defining indicia thereon, said fort area is located on segments contiguous to said fort area and one of said sea segments.

6. A board game as claimed in claim 4 wherein said land pieces include cannons, soldiers, cavalry and kings and said sea pieces include ships capable of transporting said land pieces across said sea areas.

7. A war game as claimed in claim 1 or 4 further comprising a set of instruction cards which contain information to be acted upon when selected by a player allowing the position of that player in the game to be varied.

8. A war game as claimed in claim 1 or 4 wherein the playing board represents a map, and the "land" and "sea" areas are of contrasting colours.

9. A war game as claimed in claim 1 or 4 wherein each set of playing pieces includes at least one "king" and a plurality of "ships", "soldiers" and "cavalry."

10. A war game as claimed in claim 9 wherein the ships, cavalry and kings may move up to six segments, cannons up to two segments and soldiers up to four segments in any direction.

* * * * *